United States Patent [19]

Gannaway

[11] 4,330,239

[45] May 18, 1982

[54] COMPRESSOR MUFFLER

[75] Inventor: Edwin L. Gannaway, Adrian, Mich.

[73] Assignee: Tecumseh Products Company, Tecumseh, Mich.

[21] Appl. No.: 83,350

[22] Filed: Oct. 10, 1979

[51] Int. Cl.[3] ..... F04B 39/00; F01N 1/08

[52] U.S. Cl. ..... 417/312; 181/272; 181/403

[58] Field of Search ..... 181/230, 265-266, 181/272, 403; 417/312

[56] References Cited

U.S. PATENT DOCUMENTS

| | | | |
|---|---|---|---|
| 1,535,787 | 4/1925 | Ragany | 181/265 |
| 2,290,818 | 7/1942 | Tyskewicz | 181/265 |
| 2,437,446 | 3/1948 | Stephens | 181/403 X |
| 2,501,751 | 3/1970 | Aldridge | 137/568 |
| 2,631,614 | 3/1953 | Stephens | 138/26 |
| 2,659,450 | 11/1953 | Baird | 55/396 |
| 2,841,236 | 7/1958 | Moerke | 181/238 |
| 3,125,182 | 3/1964 | Earley | 181/272 |
| 3,198,284 | 8/1965 | Powers | 181/266 |
| 3,511,617 | 5/1970 | Lyben | 422/171 |
| 3,645,358 | 2/1972 | Kubota et al. | 181/211 |
| 3,785,453 | 1/1974 | Buonocore et al. | 181/266 |
| 3,993,160 | 11/1976 | Rauch | 181/266 |
| 4,111,278 | 9/1978 | Bergman | 181/266 |

FOREIGN PATENT DOCUMENTS 2436877 4/1980 France .

*Primary Examiner*—L. T. Hix
*Assistant Examiner*—Thomas H. Tarcza
*Attorney, Agent, or Firm*—Albert L. Jeffers; John F. Hoffman

[57] ABSTRACT

A muffler for a refrigeration gas compressor which is tuned such that the attenuation curve and the impedance curve cross the frequency axis at the pumping frequency of the compressor so as to result in optimum sound attenuation for the higher frequencies with minimum impedance at the pumping frequency. The muffler comprises a housing having first and second compartments with an inlet tube in the first compartment adapted for connection to a compressor gas outlet line to permit gas flow from the compressor gas outlet into the first compartment. An elongated tube has a first section in the housing with an inlet in the first compartment, a second section in the housing with an outlet in the second compartment, with these sections being joined by a third curved section disposed entirely outside of the housing. An outlet from the second compartment leads to the exterior of the compressor housing.

15 Claims, 4 Drawing Figures

COMPRESSOR MUFFLER

BACKGROUND OF THE INVENTION

This invention relates to mufflers and, particularly, to mufflers for hermetically sealed refrigerator compressor assemblies.

For many years, efforts have been made in the prior art design of such mufflers to enhance the sound attenuation of the muffler of the refrigeration compressor assemblies without decreasing the efficiency of the assembly.

Solutions to this problem in the prior art included the utilization of a compartmentalized muffler with internal flow gas tubes interconnecting the compartments. However, considerations of the parameters of size and cost severely restricted the ability to obtain a muffler design balancing optimum sound attenuation and operational efficiency for any given compressor motor size.

SUMMARY OF THE INVENTION

With the present invention, these problems and difficulties of the prior art, among others, are substantially overcome by the provision of a muffler unit, particularly adapted for use with hermetically sealed refrigeration compression assemblies, having both improved sound attenuation and operational efficiency within the confines of the size, shape and cost predetermined by the compressor assembly overall design limitations.

In addition, in accordance with the present invention, the diameter and length of the muffler internal gas flow tubes for any given compressor motor size can readily be determined.

It is, therefore, an object of the present invention to provide an improved muffler for hermetically sealed compressor assembly systems.

Another object of the present invention is to provide a substitute for prior art muffler units which can be simply and economically interchanged with prior art mufflers of existing refrigeration compressor systems.

Still another object of the present invention is to provide an improved muffler having a minimum of component parts.

A further object of the present invention is to provide a muffler which is efficient in operation and economical to manufacture.

A still further object of the present invention is to provide a simple and effective method of determining an efficient muffler design based on the size and operation of the compressor motor.

BRIEF DESCRIPTION OF THE DRAWINGS

These and other objects, features and advantages of the present invention, among others, will become readily apparent to one skilled in the art from a careful consideration of the following detailed description, when considered in conjunction with the accompanying drawing, wherein like reference numerals refer to like and corresponding parts throughout the several views and, wherein.

DESCRIPTION OF A PREFERRED EMBODIMENT

Figure 1:
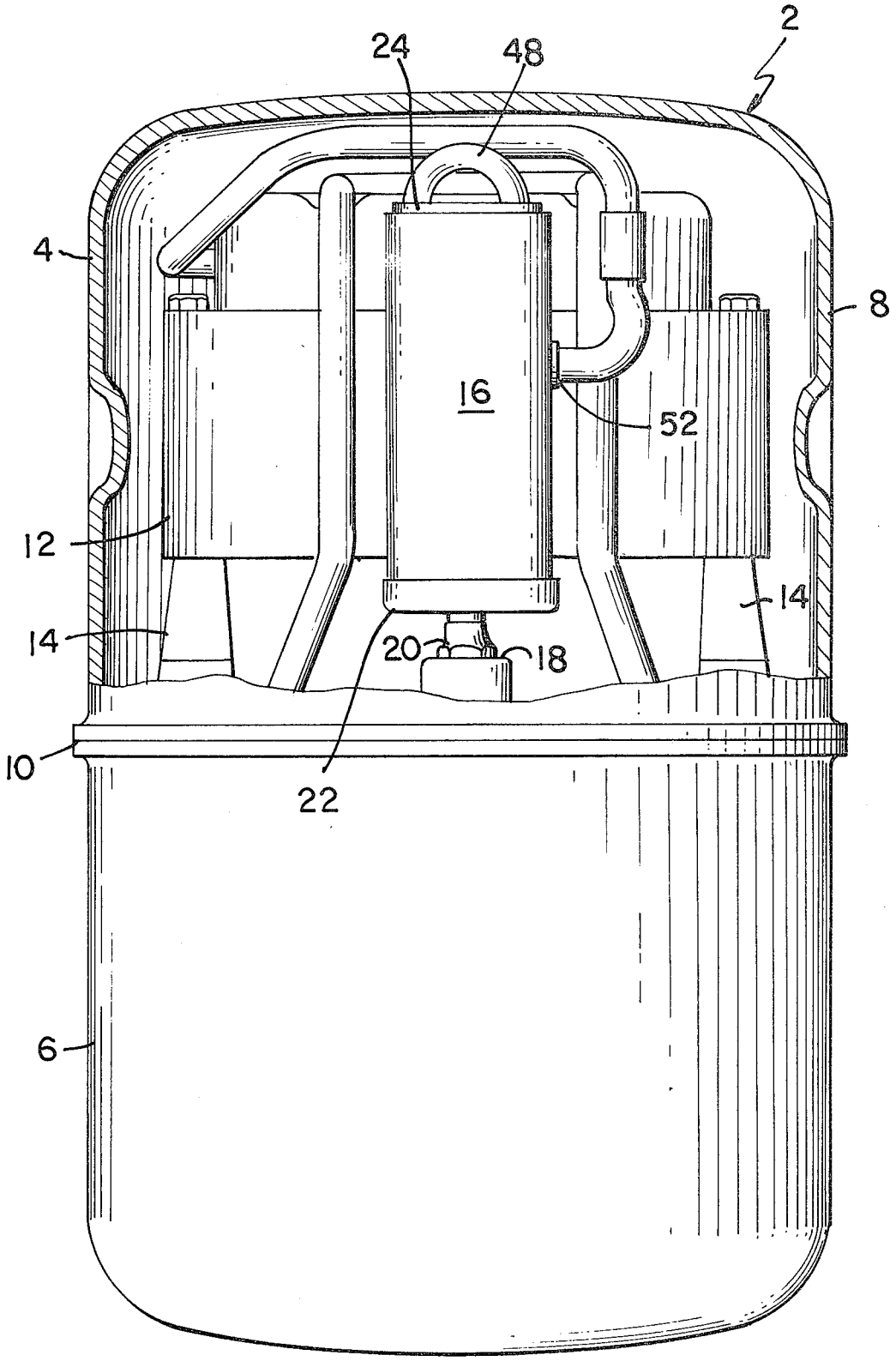
FIG. 1 is a view partially broken away and partially in elevation of a refrigeration system compressor and compressor motor assembly which includes a muffler constructed in accordance with the present invention.

Referring to FIG. 1, there is shown a refrigeration system compressor assembly, generally indicated by the numeral 2, which is of the hermetically sealed type, including the compressor motor.

The compressor assembly 2 includes an external housing shell 4 with a lower housing section 6 and an upper housing section 8 which is secured at the parting line 10, as by welding.

The assembly 2 includes a conventional motor 12 which is mounted in the upper half, or section 6, on four spaced motor mounts 14, two of which are shown in FIG. 1. The assembly 2 also houses the other conventional compressor components, such as those of the refrigeration compressor assembly sold by Tecumseh Products Company of Tecumseh, Mich., under the trade designation "A H Air Conditioning and Heat Pump Compressors".

A muffler unit 16, constructed in accordance with the present invention is enclosed also in the upper section 8 of the assembly 2 adjacent to but offset from the motor 12 and connects to a compressor gas outlet attachment 18 by a compressor muffler inlet 20. The unit 16 is readily substitutable for the muffler unit now used in the "A H" compressor assembly above mentioned without changing the size parameter or relation of components in the "A H" compressor assembly.

Figure 2:
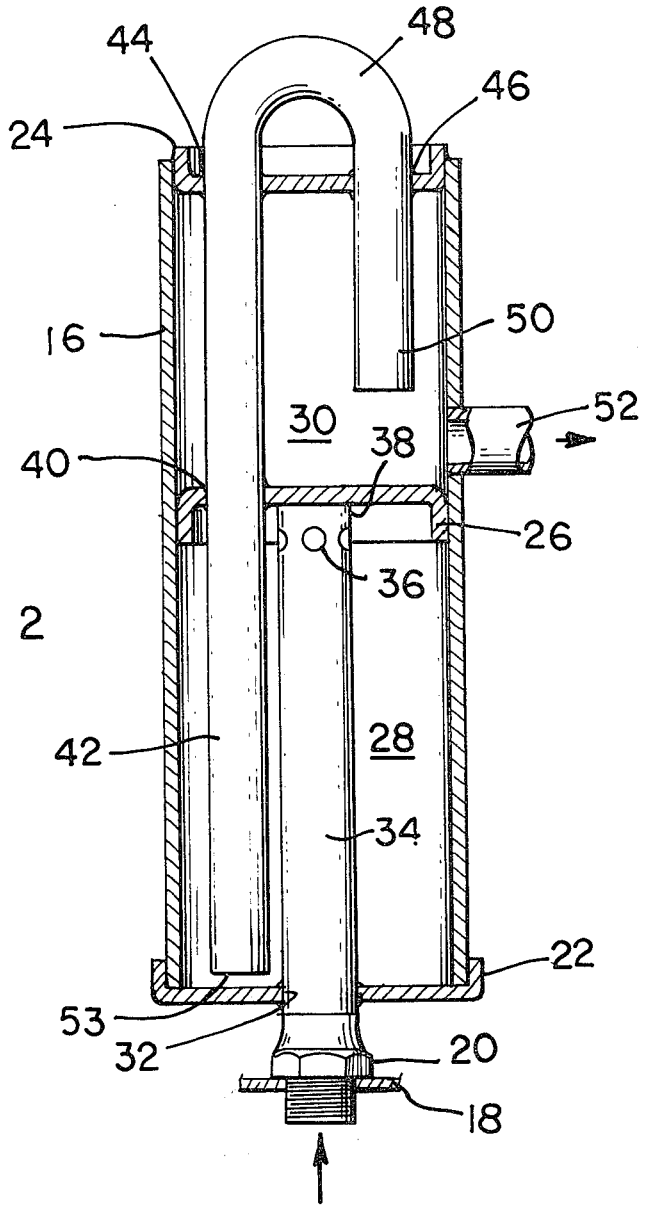
FIG. 2 is a view in vertical section of the muffler in FIG. 1.
Figure 3:
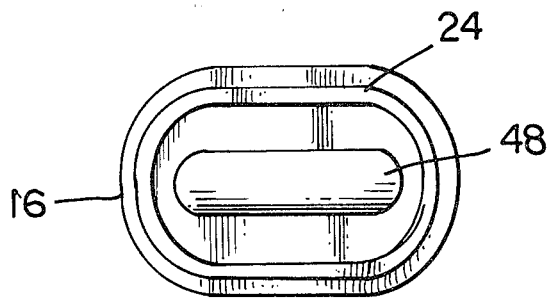
FIG. 3 is an end view of the muffler of the present invention.

The muffler unit includes a cylindrical body 16, as shown in FIGS. 2 and 3, having a lower end wall 22 spaced from an upper end wall 24. A partition wall 26 divides the unit 16 into a first lower compartment 28 coaxial with a second upper compartment 30, both of the compartments being adapted for gas flow therethrough.

The bottom end wall 22 includes a sealed opening 32 through which passes an elongated tube 34 perforated as at 36 to permit passage of gas from the compressor unit, in the direction indicated by the arrow in FIG. 2, into the tube 34 for dispersion therefrom through the tube apertures 36. The total cross-sectional area of apertures 36 equals the cross-sectional area of tube 34. If desired, the upper end 38 of the tube 34 may be connected, as by brazing, to the partition wall 26 (FIG. 2).

The partition wall 26 is provided with an opening 40. An elongated muffler tube having a straight section 42 extends through the sealed opening 40 in the partition wall 26 and extends through compartment 30 to the end wall 24.

End wall 24 is provided with a pair of spaced sealed openings 44 and 46 through which extends a curved or U-shaped section 48 of the elongated muffler tube which is joined to a second tube section 50, which is shown of shorter length than the longer tube section 42. It will be appreciated that the opening 40 of the partition wall 26 and the openings 44 and 46 of the end wall 24 are sealed to prevent gas flow from between the compartments 28 and 30 and from the chamber 30 to the ambient, respectively. The outlet of the tube section 50 is preferably located adjacent gas flow outlet 52 of the compartment 30. The end 53 of tube 42 is preferably spaced from wall 22 slightly more than one-fourth the diameter of tube 42.

It will also be appreciated that, while the tube sections 42, 48 and 50 are shown as a unitary tube forming an inverted J-shaped tube, the longer linear tube section 42 and smaller linear tube section 50 may be separate sections joined with a third curved or U-shaped section 48, depending upon the method of assembly adopted. In any event, in accordance with the present invention, the U-shaped section 48 is located entirely outside of the gas cylinder 16, and is mounted to have an outlet and inlet to the chamber or compartment, such as 30, having the muffler gas outlet 52.

The present technology has developed many methods in an attempt to optimize the most desirable balance between sound attenuation and minimum impedance (muffler inlet to outlet pressure drop) so that the efficiency of the muffler is maximized. However, as far as I am aware, these attempts, while they have enhanced efficiency to some extent, did not maximize such efficiency.

Figure 4:
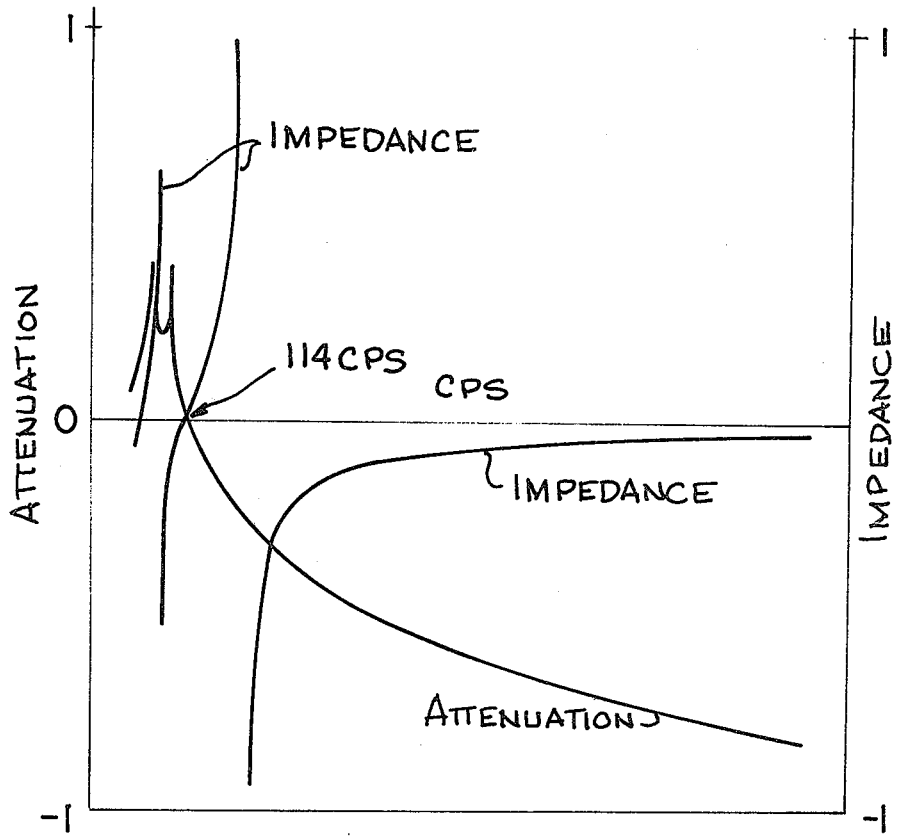
FIG. 4 is a graph illustrating the improved method of the present invention for determining the minimum impedance obtainable as a function of the sound attenuation for any given compressor motor size.

Referring to FIG. 4, there is illustrated a graph indicating a muffler attenuation curve (attenuation) and muffler impedance curve (impedance) for a muffler constructed in accordance with the present invention. The CPS line of FIG. 4 represents the gas pulse frequency F in cycles per second (cps). For a two cylinder compressor motor operating at 60 cps per cylinder, the pumping frequency is approximately twice the motor frequency, i.e. 114 cps.

Where the sound attenuation curve and the impedance curve cross the frequency axis at the pumping frequency of 114 cps, one finds optimum sound attenuation as well as the minimum impedance for the selected motor operating at the predetermined frequency F in cycles per second.

Thus, to find the optimum frequency F, the motor speed (in cps) is multiplied by the number of cylinders of compressor in accordance with the formula $F_{cps}$32 motor cps times the number of compressor cylinders. This method of tuning at 114 cps establishes the minimum impedance and pressure drop at the pumping frequency and simultaneously establishes the maximum sound attenuation for the allotted space. Tuning at low frequency can be accomplished by using large volumes, long tubes (tubes 34 and 42) or small area tubes. Using long tubes requires less space than large volumes. In this case, tube 42 is cane shaped and extended beyond the muffler wall 24 so as to obtain the desired length. Above the optimum frequency, the sound attenuation increases rapidly thereby reducing the high frequency sound, which is most objectionable.

A specific muffler constructed so as to perform in accordance with FIG. 4 has the following dimensions:

Compartment 28=5.44 in. cu. in.

Compartment 30=2.72 in. cu. in.

Tube Length 34=3.8 inc.

Tube inner diameter 34=0.430 in.

Tube length 42=7.84 in.

Tube inner diameter 42=0.319 in.

While there has been disclosed a particular embodiment of the present invention, other embodiments will become readily apparent to one skilled in the art, and, accordingly, this invention should be considered to be limited in scope only by the accompanying claims.

What is claimed is:

1. In combination with a hermetic gas compressor having a housing and having a given pumping frequency at its outlet, a muffler mounted within the compressor housing comprising: a housing having an inlet in fluid communication with the compressor outlet, at least two chambers separated by a partition wall, an inlet tube in one of said chambers adapted to permit gas flow into said one of said chambers, said inlet tube being in fluid communication with the housing inlet, an elongated tube having an inlet end in said one chamber and an outlet end the other of said chambers adapted to permit gas flow from said one chamber to said other chamber, an intermediate portion of said elongated tube extending out of said other chamber and returning to said other chamber and being disposed entirely outside said one chamber and said other chamber, an outlet in said other chamber, said muffler being tuned such that its sound attenuation and impedance characteristics are each substantially zero at the compressor pumping frequency and the attenuation increasing at frequencies above the pumping frequency.

2. The combination of claim 1 wherein said elongated tube comprises a portion within said one chamber, a second portion and a third portion each being in said another chamber, said second and third portions being joined by said intermediate portion.

3. The combination of claim 1 wherein said muffler housing comprises: the first wall through which said inlet tube passes, and a second end wall, and said intermediate portion extends through two openings in said second end wall.

4. The combination of claim 3 wherein said intermediate section is arcuate.

5. The combination of claim 1 wherein said intermediate section is disposed completely outside of said muffler housing.

6. The combination of claim 3 wherein said elongated tube extends from said one chamber through said partition wall into said other chamber.

7. The combination of claim 6 wherein said elongated tube is carried by said partition wall and said second end wall.

8. The combination of claim 1 wherein said muffler comprises only two said chambers, and said one chamber is larger than the other chamber.

9. The combination of claim 3 wherein the inlet end of the elongated tube is spaced from but in close proximity to the housing first end wall.

10. The combination of claim 6 wherein the elongated tube is a unitary tube, the intermediate section of which passes through spaced apertures in the second end wall.

11. The combination of claim 1 wherein the muffler is cylindrical.

12. The combination of claim 1 wherein the inlet tube is coaxial with said muffler housing.

13. The combination of claim 6 wherein said elongated tube is an inverted J-shaped tube carried by said partition wall and said second end wall, the intermediate section of said elongated tube being disposed entirely outside the said housing.

14. The combination of claim 13 wherein the inlet tube is carried at one end by the partition wall.

15. The combination of claim 13 wherein the J-shaped tube inlet is narrowly spaced from the muffler housing first end wall.

* * * * *

UNITED STATES PATENT AND TRADEMARK OFFICE

CERTIFICATE OF CORRECTION

PATENT NO. : 4,330,239

DATED : May 18, 1982

INVENTOR(S) : Edwin L. Gannaway

It is certified that error appears in the above—identified patent and that said Letters Patent is hereby corrected as shown below:

Column 3, line 39, change "32" to equal sign (=).

Column 4, line 11, after "end" should read -- in --.

Signed and Sealed this

*Fifth* Day of *October 1982*

[SEAL]

*Attest:*

GERALD J. MOSSINGHOFF

*Attesting Officer*

*Commissioner of Patents and Trademarks*